US006688663B2

(12) United States Patent
van Asch et al.

(10) Patent No.: US 6,688,663 B2
(45) Date of Patent: Feb. 10, 2004

(54) RETRIEVAL EQUIPMENT FOR DEPLOYED BUNGY

(75) Inventors: Paul Henry Drury van Asch, Queenstown (NZ); Keith Vivian Alexander, Christchurch (NZ)

(73) Assignee: Fun Innovators NZ Limited (NZ)

( * ) Notice: Subject to any disclaimer, the term of this patent is extended or adjusted under 35 U.S.C. 154(b) by 0 days.

(21) Appl. No.: 10/367,503

(22) Filed: Feb. 13, 2003

(65) Prior Publication Data

US 2003/0122391 A1 Jul. 3, 2003

Related U.S. Application Data

(62) Division of application No. 09/744,533, filed as application No. PCT/NZ99/00119 on Jul. 28, 1999, now abandoned.

(30) Foreign Application Priority Data

Jul. 28, 1998 (NZ) ..... 331200

(51) Int. Cl.[7] ..... B66C 1/62
(52) U.S. Cl. ..... 294/82.32; 294/97
(58) Field of Search ..... 294/66.1, 66.2, 294/82.24, 82.27, 82.31, 82.32, 90, 93, 97, 102.2, 113, 114; 24/132 R; 472/131, 135, 137

(56) References Cited

U.S. PATENT DOCUMENTS

| | | | | |
|---|---|---|---|---|
| 1,426,563 A | | 8/1922 | Gariglio | |
| 3,445,133 A | * | 5/1969 | Reischl | 294/82.1 |
| 3,458,230 A | | 7/1969 | Jones et al. | |
| 3,661,416 A | | 5/1972 | Bukarin et al. | |
| 3,713,414 A | | 1/1973 | Wischhoefer et al. | |
| 3,853,082 A | | 12/1974 | Rosenberg et al. | |
| 4,130,313 A | | 12/1978 | Clifford | |
| 4,214,842 A | * | 7/1980 | Franks | 405/191 |
| 4,258,888 A | | 3/1981 | Sawn | |
| 4,644,617 A | | 2/1987 | Tupper et al. | |
| 4,725,088 A | | 2/1988 | Mank | |
| 4,736,978 A | * | 4/1988 | Cielker | 294/90 |
| 5,094,448 A | | 3/1992 | Hackett | |
| 5,203,744 A | | 4/1993 | Checketts | |
| 5,688,012 A | | 11/1997 | Siesjo et al. | |

FOREIGN PATENT DOCUMENTS

| | | |
|---|---|---|
| CA | A-2109908 | 5/1995 |
| DE | 674189 | 4/1939 |
| IT | 636758 | 3/1962 |
| SU | 242355 | 4/1969 |
| WO | WO 92/19325 | 11/1992 |
| WO | WO 92/19325 A1 | 11/1992 |

OTHER PUBLICATIONS

Grafstein, P., Schwarz, O., "Pictorial Handbook of Technical Devices", Chemical Publishing Co., Inc., New York (1971), pp. 105–106.

* cited by examiner

*Primary Examiner*—Dean J. Kramer
(74) *Attorney, Agent, or Firm*—Christie, Parker & Hale, LLP

(57) ABSTRACT

Retrieval equipment for a deployed bungy essentially comprising a retrieval/hauling member and a terminal coupling unit connectable to or integral with the free end of the bungy. The retrieval/hauling member is attached to a retrieval cable and is provided with an aperture for receipt of the bungy. Releasable engagement of the retrieval/hauling member and the terminal coupling unit and subsequent hauling retrieves the deployed bungy back to the jump site.

8 Claims, 9 Drawing Sheets

Fig. 5
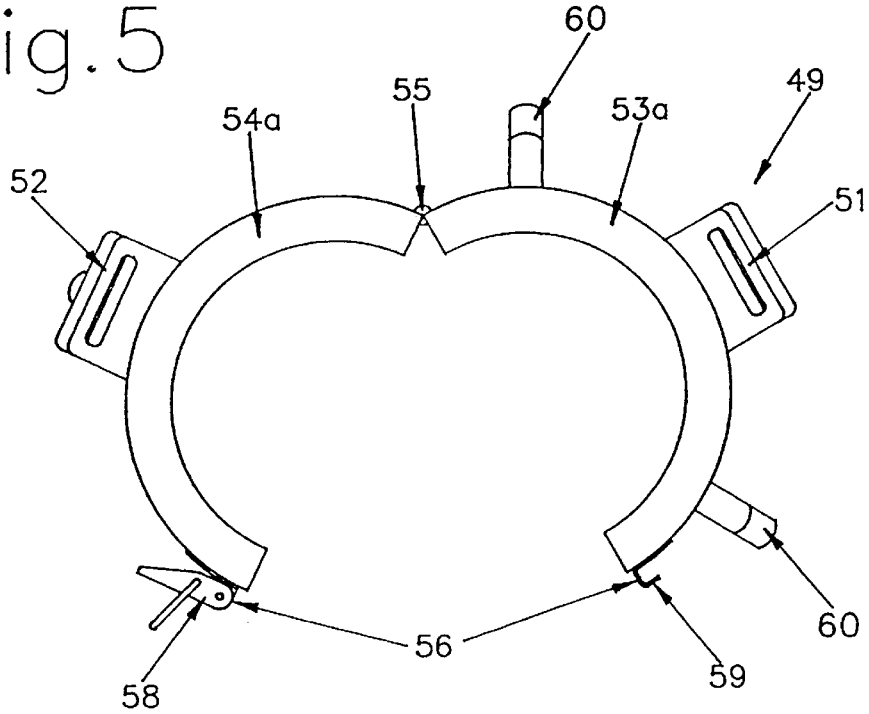
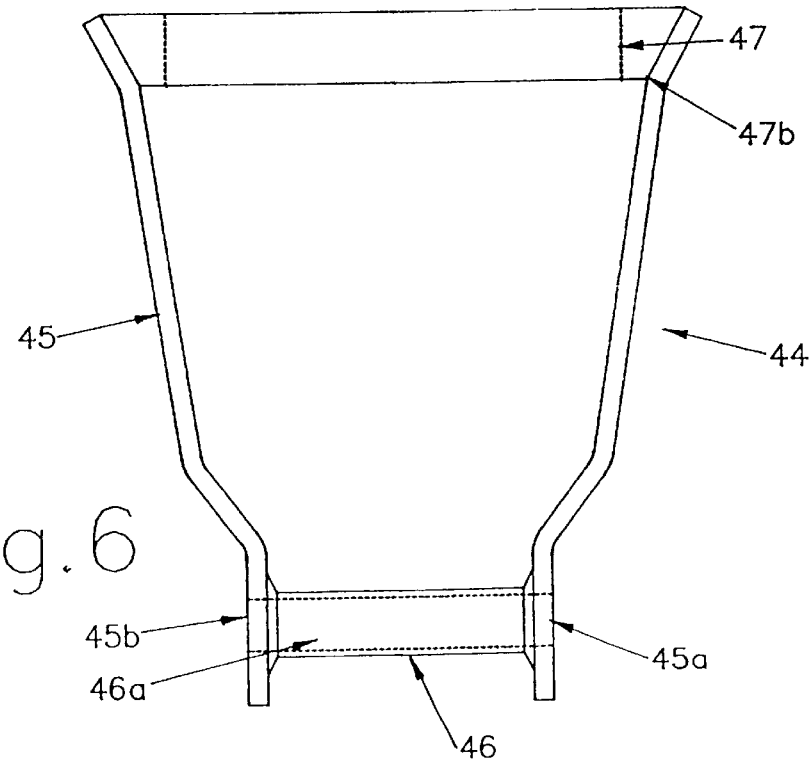
Fig. 6

RETRIEVAL EQUIPMENT FOR DEPLOYED BUNGY

CROSS-REFERENCE TO RELATED APPLICATIONS

This application is a divisional application of Application Ser. No. 09/744,533, filed Jan. 23, 2001, now abandoned which claims priority of PCT Application No. PCT/NZ99/00119, filed Jul. 28, 1999, which claims priority of New Zealand Application No. 331200, filed Jul. 28, 1998, which issued on May 12, 2000 as New Zealand Patent No. 331200, the entire disclosure of which is expressly incorporated herein by reference.

TECHNICAL FIELD

The present invention relates to retrieval equipment for a deployed bungy and more particularly to a novel retrieval/hauling unit which is inter-engageable with a bungy terminal coupling unit and method of using same.

As used herein the term "bungy" means an elongated elastic member, such as a vine, cord, rope or strap, more typically a multi-stranded latex cord.

BACKGROUND ART

The pursuit of bungy jumping from a structure such as a cliff, bridge, jumping platform or tower is known. One end of the bungy is releasably anchored to said structure and the free end is releasably attached to a terminal connection means (e.g. a karabiner or coupling unit) from which the harness or ankle-cuff secured to the jumper can be releasably connected thereto. Typically, the bungy is releasably anchored to said structure by means of a tethering cable secured to a crane arm located at the jump site.

At present, upon completion of the jump, the jumper is lowered to a landing site adjacent the base of the structure (for example, lowering the jumper into a gorge for boat pickup) or operational crew secure the deployed bungy to a retrieval cable connected to a winching system (e.g. a crane operated winch, windlass or vehicular tow hauling) to return the suspended jumper to the structure and/or retrieve the bungy. The free end of the retrieval cable is lowered from the jump site to operational crew at the landing site, who then releasably secure the cable to the deployed bungy terminal connection. On voice or hand signal command from the landing site crew, the jump site crew engage and control the winching system. Alternatively, the bungy may be manually hauled up to the jump site once the jumper has been released from the deployed bungy.

It can often be a long and arduous task, involving a number of crew members, to secure the retrieval cable to the deployed bungy and manipulate the retrieved bungy length, given the weight and elastic properties of the bungy. The deployed bungy can swing with exposure to air turbulence such as wind gusts or helicopter back-draughts. The effect of air turbulence can be a major factor, particularly if the landing site is located in a gully or ravine. The retrieval cable may frequently become intertwined with the deployed bungy length during its descent to the landing site. Similarly, the weight and movement of the bungy during hauling can slow the operation of retrieval.

The strain and effort of a manual haul can be exhausting for the operators and may lead to back injury, particularly if the jump rate is high and/or the distance between the landing site and jump site is large. The hauling position becomes uncomfortable with time in view of the necessity to wear a safety harness.

DISCLOSURE OF INVENTION

It is an object of the present invention to provide improved retrieval equipment for a deployed bungy, which is easy and rapid to operate, dismantle for transport to an alternative jumping site or store out of use.

The present invention provides retrieval equipment for a deployed bungy comprising a retrieval/hauling member provided with an aperture for receipt of said bungy, a terminal coupling unit connectable to or integral with the free end of the bungy, means to attach said retrieval/hauling member to a retrieval cable; said retrieval/hauling member being releasably engageable with said terminal coupling member.

It will be appreciated that the retrieval/hauling member may be directly or indirectly connected to the terminal coupling unit. For example, the retrieval/hauling unit may connect onto the securing means provided for the jumper (i.e. tethering rope or webbing sling, ankle cuff or harness) secured to the terminal coupling unit.

Preferably said aperture is a passage through the retrieval/hauling member. Preferably said retrieval/hauling member includes a releasable opening mechanism.

The retrieval/hauling member is substantially symmetrical in shape and said aperture is concentric relative to the central axis thereof. Alternatively, said aperture is offset. Preferably said opening mechanism is a lockable hinged opening. Alternatively said opening mechanism is effected by the dis-engagement of over-centre latches located on opposing sides of the retrieval/hauling member.

In two preferred forms of the present invention, the invention provides a terminal coupling unit having a continuous peripheral projection adapted to inter-engage with said retrieval/hauling member and/or function as a guide member for the passage of the retrieval/hauling member; wherein said retrieval/hauling member is a collar comprising a body and an attachment to secure said retrieval/hauling member to a retrieval cable. Preferably said body includes a retractable retaining means biased to a locking position.

In a preferred embodiment, said attachment means is an extension arm. Preferably the free end of said extension arm is adjacent but slightly offset from the central axis of an engaged said terminal coupling unit without obstructing the top opening of same. Preferably said extension arm is detachable from said body for maintenance, transport or storage. Preferably said body is rotatably secured to said extension arm. More preferably, said extension arm is biased to an upright position by a spring release mechanism such that the engagement of said spring release means inverts the body of said collar to assist an operator in removing an engaged terminal coupling unit from said retrieval/hauling member. That is, it is easier and a more safe procedure to lift the terminal coupling unit from the retrieval/hauling member when the free end of the bungy is orientated above the retrieval/hauling member. Alternatively said attachment is a plurality of equi-distantly-spaced lugs located on the periphery of said collar.

BRIEF DESCRIPTION OF THE DRAWINGS

By way of example only, preferred embodiments of the present invention are described in detail, with reference to the accompanying drawings in which:—

FIG. 5 is a plan view from above of a second preferred retrieval/hauling member shown in the open position, FIG. 6 is a side view of another preferred terminal coupling unit in accordance with the present invention.

BEST MODES FOR CARRYING OUT THE INVENTION

Figure 1:
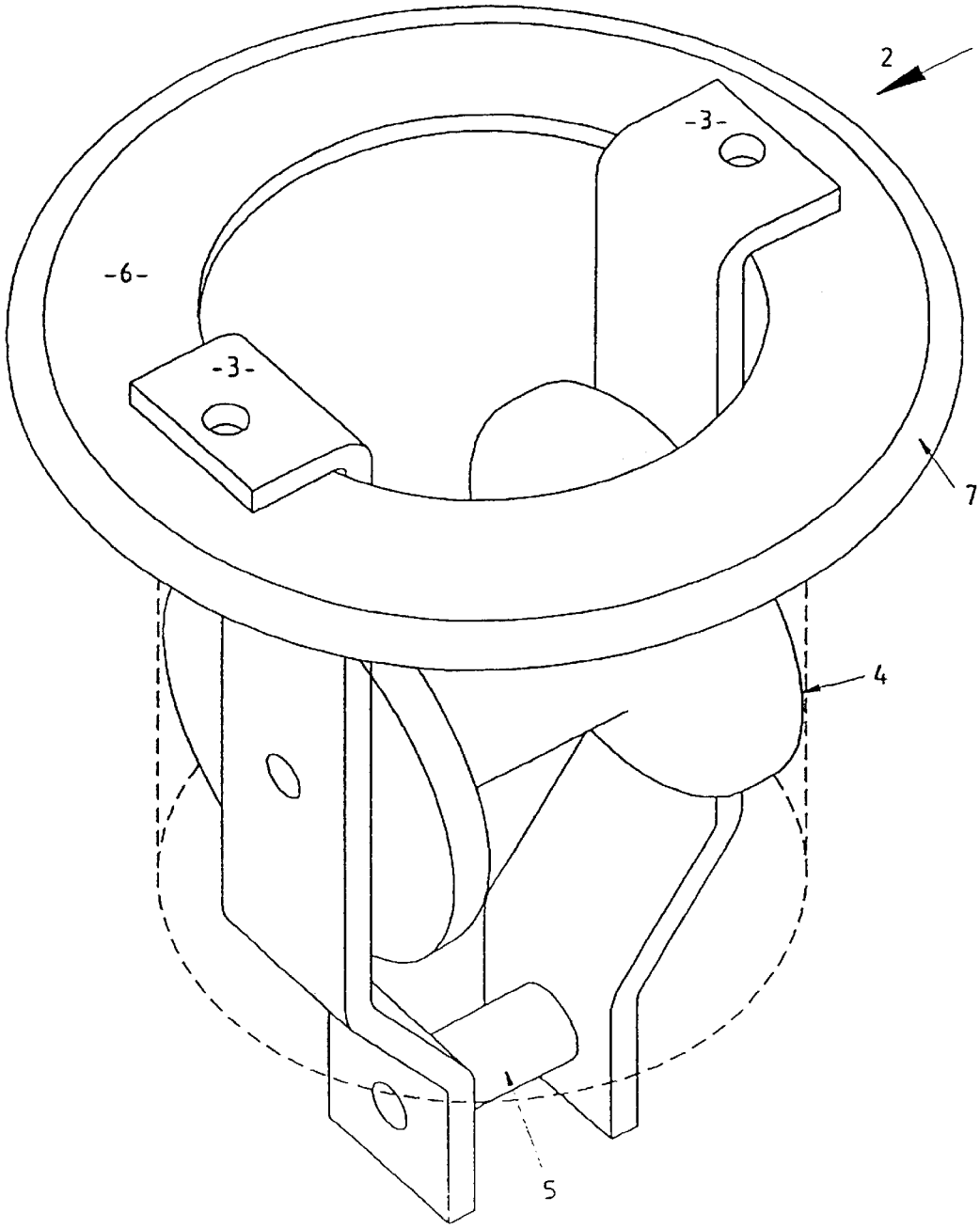
FIG. 1 is a perspective view of a terminal coupling unit of a first preferred embodiment of the present invention.
Figure 2:
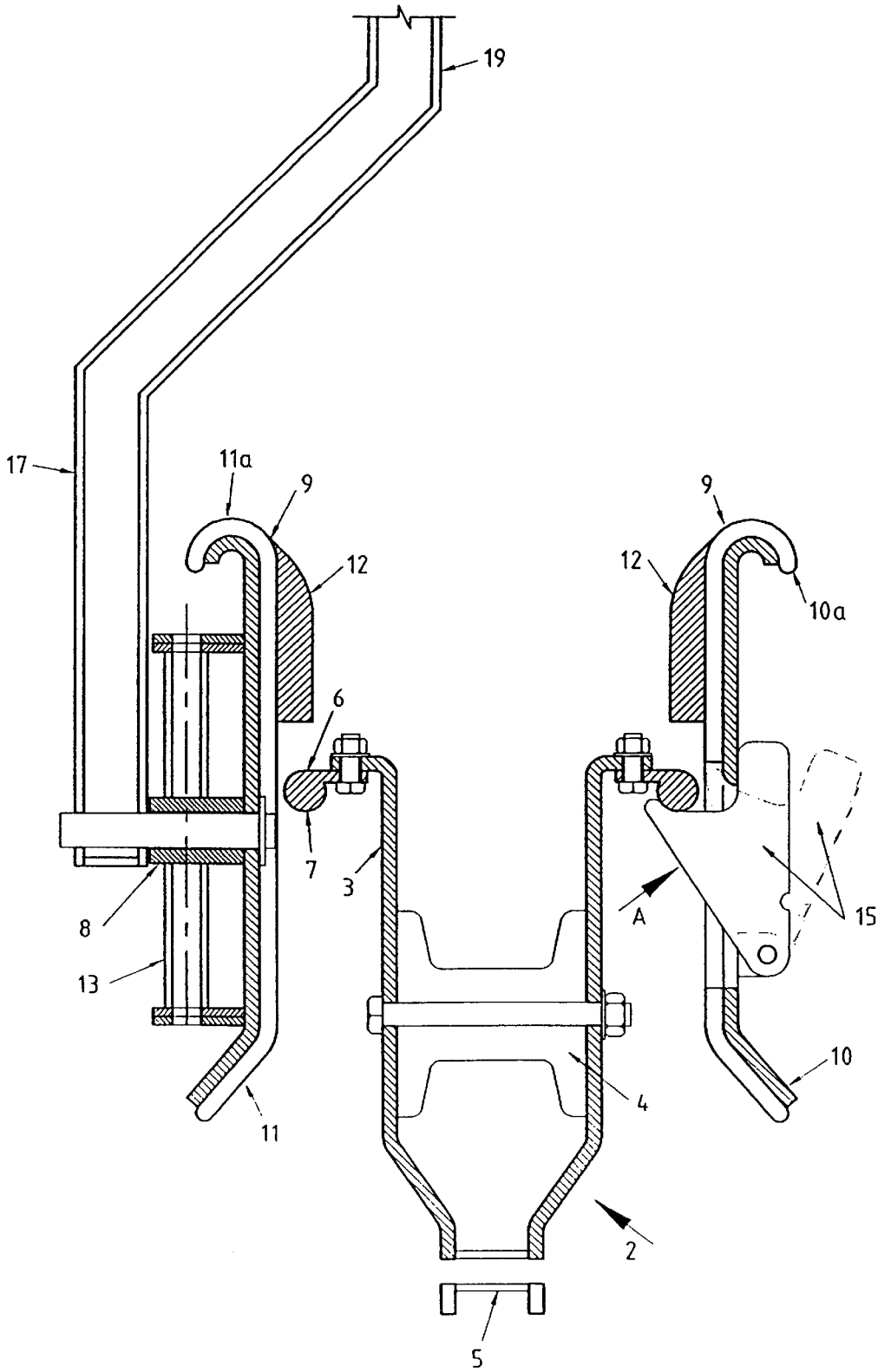
FIG. 2 is a cross-sectional view of the terminal coupling unit of FIG. 1 inter-engaged with a retrieval/hauling member of the present invention.
Figure 3:
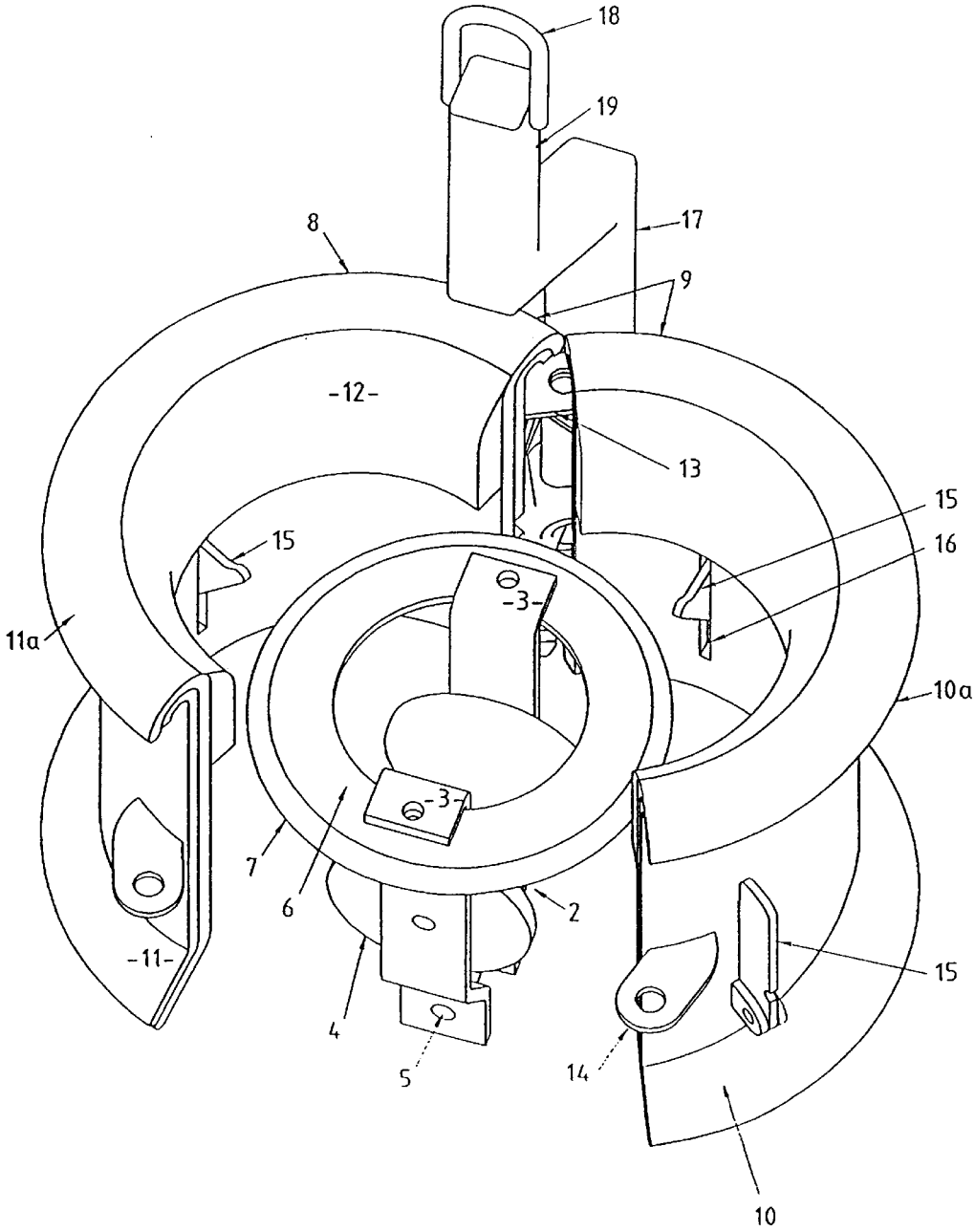
FIG. 3 is a perspective view of FIG. 2 showing the retrieval/hauling member in an open position wherein the terminal coupling unit is disengaged therefrom.

Referring to FIGS. 1–3 in general, a first preferred embodiment of the two essential components of the retrieval equipment for a deployed bungy, a terminal coupling unit 2 and retrieval/hauling member 8 (FIGS. 2 and 3) are there-shown.

With particular reference to FIG. 1, the terminal coupling unit 2 comprises a bracket 3 supporting a reel 4, tethering bar 5 and ring 6. In use, the free end of a bungy is secured around the spool of the reel 4, and the harness or ankle-cuff is releasably connected to the tethering bar 5 usually via means of a karabiner and tethering rope. The rim of the ring 6 is formed as a continuous peripheral projection 7. The peripheral projection 7 provides a flange as a contact point for inter-engagement with the retrieval/hauling member to initiate retrieval of the deployed bungy as hereinafter described. Preferably, the ring 6 is removable for maintenance or replacement.

With reference to FIGS. 2 and 3, the retrieval/hauling member 8 comprises a releasable split collar 9 and an extension arm 17. The collar 9 consists of two mirror image substantially crescent shaped sections 10, 11, secured to each other at one end thereof by means of a hinge 13. The sections 10, 11 are releasably secured at the opposing end by an external latch mechanism comprising a pair of lugs 14, and latch or locking pin (not shown). The rim of each section (10*a*, 11*a*) is rounded or beveled to provide a smooth surface for resting and drapage of the bungy length during hauling and after retrieval. Advantageously, the rim (10*a*, 11*a*) further functions as a guide means for the passage of the retrieval/hauling member 8 from the anchoring tether cable (not shown) onto the bungy length at retrieval set-up.

In the open position as depicted in FIG. 3, the latch or locking pin (not shown) is disengaged and the lugs 14 are separated via the articulation of the sections 10, 11 about the hinge 13. To close the collar 9, the free ends of sections 10 and 11 are pulled adjacent each other, so that the apertures of the lugs 14 are aligned and the latch engaged therewith. It will be appreciated that the split collar 9 may be releasably secured by alternate known mechanisms such as bolts or over-centre latches and/or these mechanisms may also be used in place of the hinge 13 and/or latch mechanism to split open the collar 9. In the closed position as depicted in FIG. 2, the secured collar 9 is formed with a central passage, having a throat guide 12 adjacent the top opening thereof. Preferably the throat guide 12 is composed of a low friction material to reduce abrasive damage of the bungy resulting from repetitive retrieval.

Each section 10, 11 has a plurality of retractable spring retaining mechanisms (15, 16). Each mechanism (15, 16) comprises a catch 15 capable of moving between an extended locking position as shown in FIGS. 2 and 3 and a retracted position (shown in dotted outline in FIG. 2) wherein the catch 15 recedes within a slot 16. Each catch 15 is biased by spring means (not visible) to the extended position wherein the hook shaped portion protrudes from the slot 16.

Figure 7:
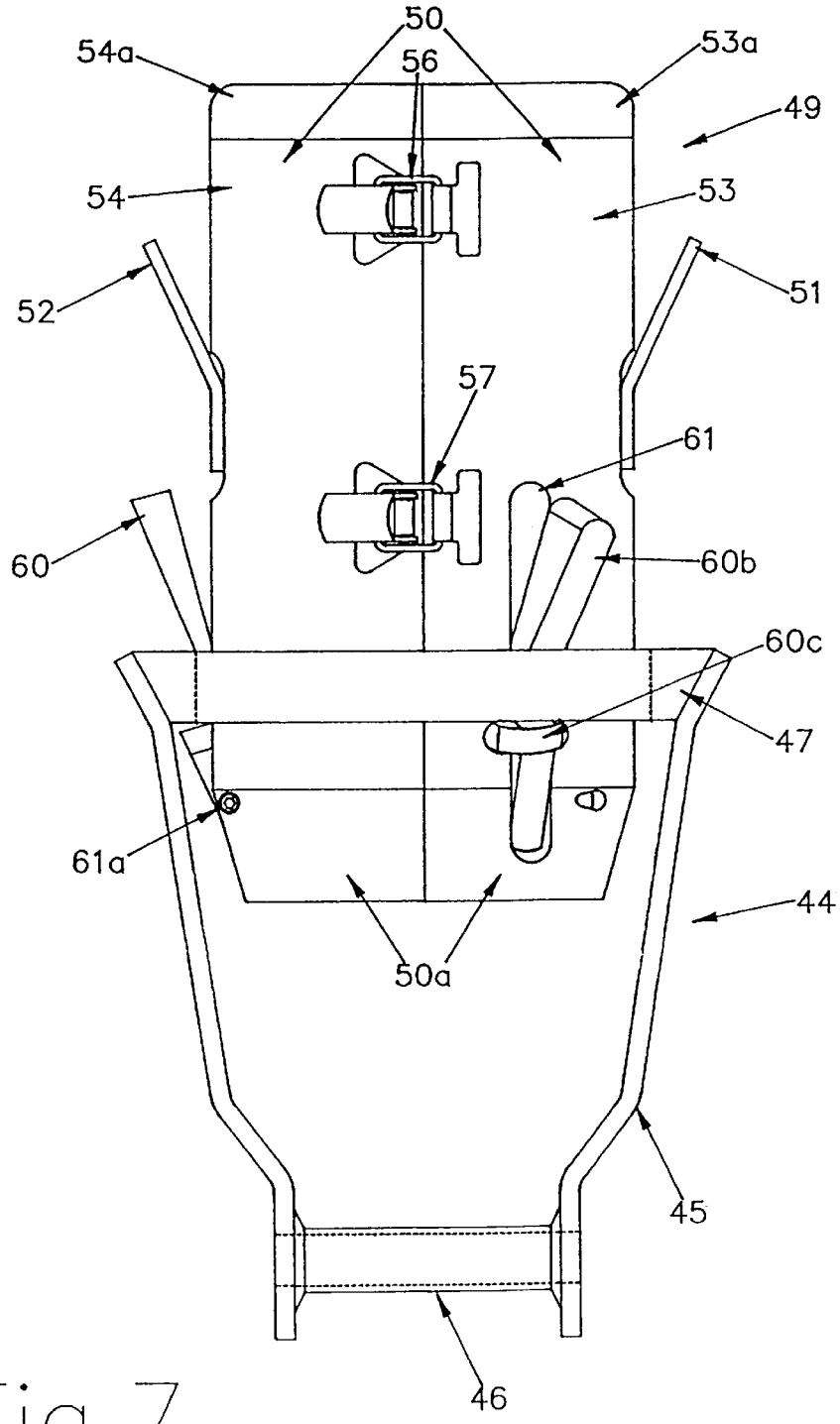
FIG. 7 is a side view showing the terminal coupling unit of FIG. 6 inter-engaged with the retrieval/hauling member of FIG. 5.

The collar 9 is supported on an extension arm 17. One end of the extension arm is secured adjacent the hinge 13 and the free end 19 is provided with a lug fitting 18 for attachment to the retrieval cable (not shown). Preferably said extension arm 17 is detachably secured to the collar 9 such that the arm 17 may be removed for maintenance, transport or storage. In use, the lug 18 and free end 19 are positioned adjacent but slightly offset from the central axis of the terminal coupling unit 2 whereby the extension arm 17 does not obstruct the top opening of the terminal coupling unit 2 provided for receipt of the free end of the bungy. Alternatively, the means to attach the retrieval/hauling member 8 to the retrieval cable is a plurality of equidistantly spaced lugs located on the periphery of the collar 9, as illustrated in respect of the third preferred embodiment 51, 52 (FIGS. 5 & 7).

In use, the free end of the bungy is attached to the terminal coupling unit 2 in advance of deployment as hereinbefore described and the retrieval/hauling member 8 is secured by the lug 18 to a retrieval cable connected to a winching system such as a crane operated winch, vehicular winch or windlass (not shown). Alternatively, the retrieval cable is secured for subsequent manual or vehicular tow hauling.

Upon completion of the jump, the jumper may be lowered to a landing site and released from the harness or ankle cuff or remain suspended secured therein for retrieval with the deployed bungy. Jump site crew thread the deployed bungy through the aperture of the collar 9 by opening the collar 9, enclosing the sections 10, 11 around the bungy and closing the collar 9 as hereinbefore described. It will be appreciated that where the retrieval cable is securely tied off or controlled by a winching system, the retrieval/hauling member 8 may be placed on the bungy length adjacent the top at jump set-up and returned to that position after the bungy has been deployed and subsequently retrieved (i.e. between consecutive jumps). The throat guide 12 restricts the degree of movement of the bungy length within the aperture of the collar 9.

To retrieve the bungy, the retrieval/hauling member 8 is run down the deployed bungy length by gravity feed of the retrieval cable or under winch control until the ring 6 of the terminal coupling unit 2 contacts and docks with the spring locking mechanisms 15, 16. The throat guide 12 prevents the deployed bungy length from being snared on the extended catches 15 or free end arm length 19, even if air turbulence effects swinging of the bungy. Docking is achieved by the inter-engagement of each catch 15 with the peripheral projection 7; the projection 7 pivots the catches 15 in the direction of Arrow A (FIG. 2) as the retrieval/hauling member 8 slides down over the terminal coupling unit 2. As the retrieval/hauling member 8 slides into the position shown in FIG. 2, the catches 15 spring back into the extended locking position shown and the hooked portion of each catch 15 supports and releasably retains the peripheral projection 7. The weight of the bungy and spring bias means of the catches 15 maintain the docked inter-engagement position of the terminal coupling unit 2 within the retrieval/hauling member 8.

The winching system is then engaged, or alternatively, the vehicular tow hauling or manual hauling is commenced until the retrieval cable, deployed bungy length, retrieval/hauling member 8 and docked terminal coupling unit 2 are back above the jump site within arm's reach of the operator. Preferably, said retrieval cable is connected to a winching system via a friction-free eddy current coupling member (e.g. a TASC unit) which provides a slipping clutch control such that the operator can brake and/or control the rate of descent and ascent of the retrieval/hauling member 8 (not shown).

Figure 4:
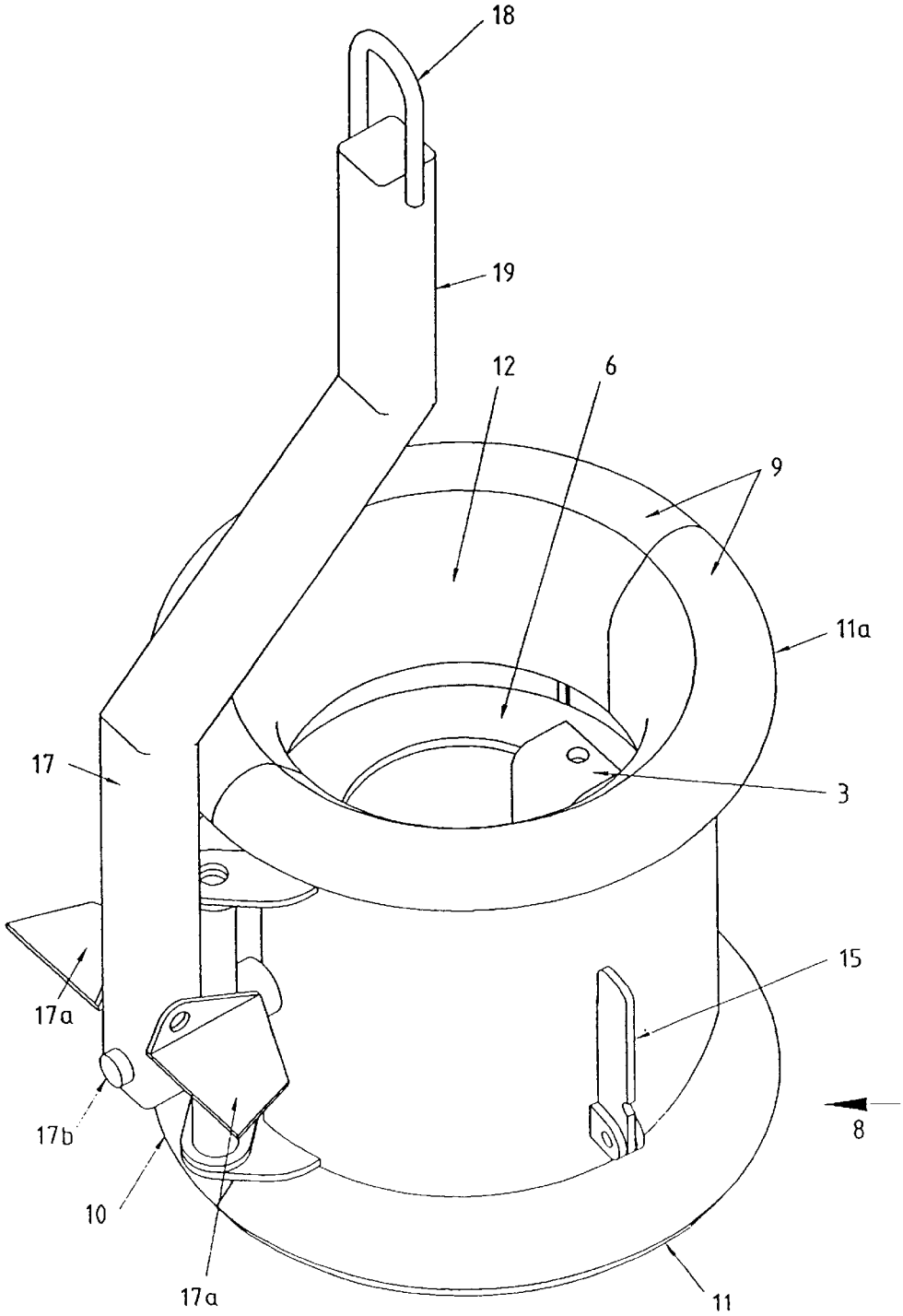
FIG. 4 is a perspective view of a modified retrieval/hauling member of FIGS. 2 & 3 wherein the collar is rotatably secured to the extension arm.

To release the terminal coupling unit 2 from the retrieval/hauling member 8, the collar 9 is opened and the sections 10, 11 are separated. To increase operational speed and afford a more safe jump re-set procedure, the retrieval/hauling member 8 (FIG. 4) can be modified whereby the collar 9 is rotatably bolt secured to the extension arm 17. The extension arm 17 is provided with a spring release mechanism 17*a,b* (FIG. 4) biased by a compression spring (not visible) to hold the extension arm in an upright position. Engagement of both spring release mechanism levers 17*a* inverts collar 9 approximately 180° such that upon rotation of the collar 9 about the pivot 17*b*, the bungy is orientated below the retrieval/hauling member 8. This orientation assists the operator in safety removing the terminal coupling unit 2 from the retrieval/hauling member 8, reducing the likelihood of dropping the bungy after disengagement. When the terminal coupling unit 2 is removed, the retrieval/hauling member 8 is returned to the upright position by depressing both levers 17*a*.

Whilst the terminal coupling unit 2 has been depicted and described as a substantially open structure, it will be appreciated that the body of the terminal coupling unit may be formed as an open ended substantially cylindrical structure (shown in broken lines in FIG. 1) incorporating a means to releasably secure the end of the bungy and means to connect the harness or ankle cuffs thereto. Similarly, the retrieval/hauling member 8 may be formed in any desired polygonal or substantially cylindrical shape wherein the aperture is concentric or offset as illustrated in FIG. 11. Further, it will be appreciated that the collar 9 need not be formed in two releasable sections (10, 11), but could be a closed cylinder, so that in use the bungy length would be manually fed through the aperture of the collar 9 (not shown). Similarly, it will be appreciated that the collar 50 need not split completely in half as depicted and described but may merely include a releasable section having a sufficient opening to allow egress of the bungy length. It will also be appreciated that either the terminal coupling unit or the retrieval/hauling member may be provided with the releasable retaining means biased to a locking position as hereinafter described in a further aspect of the present invention with reference to FIG. 10 and as described above with reference to FIGS. 2 & 3 or FIG. 4, respectively.

Referring to FIGS. 5–9 and FIG. 10, a second preferred embodiment of the two essential components of the retrieval equipment for deployed bungy, a retrieval/hauling member 49 and a terminal coupling unit 44 is thereshown.

Figure 10:
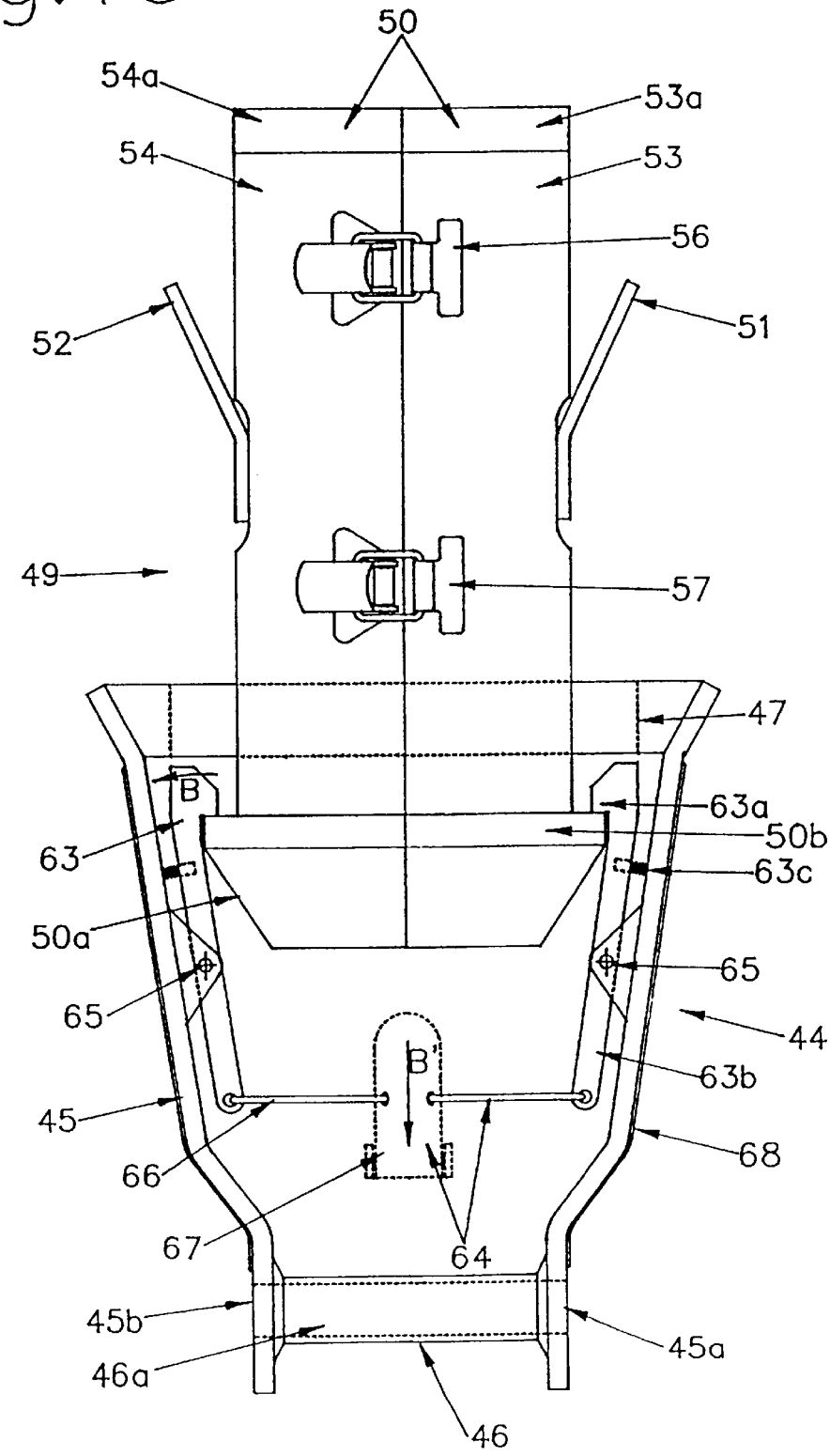
FIG. 10 is a cross sectional view showing the inter-engagement of a modified retrieval/hauling member of FIGS. 5 & 7 with a modified terminal coupling unit of FIGS. 6 & 7 wherein the terminal coupling unit is provided with the retractable retaining mechanism, and the retrieval/hauling collar is provided with a nose projection.
Figure 11:
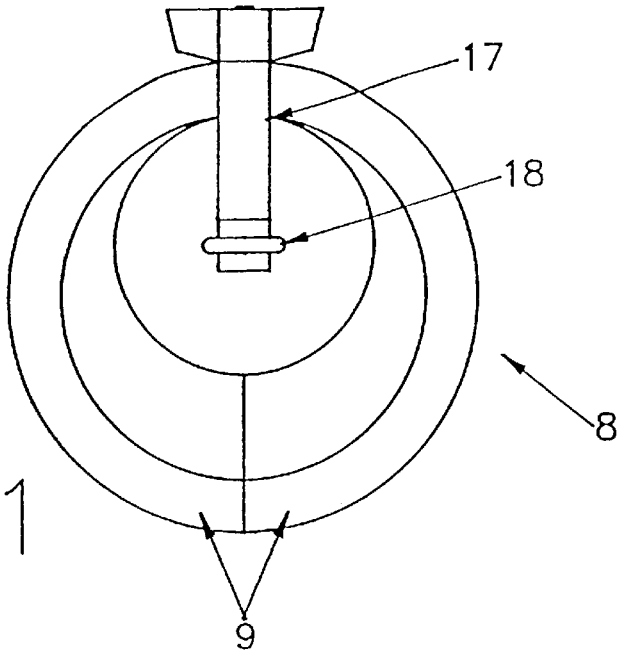
FIG. 11 is a plan view from above showing a modified retrieval/hauling member of FIGS. 2 & 3 or 4 wherein the collar aperture is off-set.

With particular reference to FIGS. 7 & 10, the terminal coupling unit 44 comprises a bracket 45 supporting a tubular housing in the form of spool 46, and a ring 47. The bracket 45 is funnel-shaped in appearance. In use, a webbing sling or tethering rope (not shown) is connected to the terminal coupling unit 44 by feeding the webbing or rope length through the bracket aperture 45*a*, the central spool cavity 46*a* and bracket aperture 45*b* respectively and then securing the free ends in known manner. A coupling such as a karabiner is attached to the webbing sling or tethering rope for subsequent connection of the bungy and the harness or ankle cuff.

The wall defining the central aperture of the ring 47 is formed with a continuous beveled lower lip 47*b* which functions as a guide means for the passage of the retrieval/hauling member and/or provides a contact point for the inter-engagement with the retrieval/hauling member to initiate retrieval of the deployed bungy as hereinafter described in detail. Preferably, the ring 47 is removable for maintenance or replacement With reference to FIG. 10, the modified terminal coupling unit 44 further carries a series of retractable spring mechanisms 63 and a manual override mechanism 64. Each retractable spring mechanism includes a catch 63*a* & *b* that is pivotably secured to the internal wall of the bracket 45. Each catch 63*a* & *b* is capable of moving between the illustrated extended locking position and a retracted position wherein the catch head 63*a* moves towards the bracket 45 in the direction of Arrow B by compression of the tensioned spring 63*c* effected by the pivotal movement about the pivot pin 65. The spring 63*c* biases the catch 63*a* & *b* to the extended position.

The manual override mechanism 64 comprises a cable 66 and a pull-down over-centre lever 67. The bracket 45 is fitted with a padded, open ended sleeve 68 which provides a surface for rigid securement of the lever 67 and advantageously acts as a shock absorber dampening the resultant engagement jolt being transmitted onto the jumper when the terminal coupling unit 44 docks with the retrieval/hauling member 49 as hereinafter described. The cable 66 is threaded through the apertures adjacent the tail portion of each catch 63*b* and the free ends are secured to the lever 67 in known manner. The cable 66 provides an interconnecting linkage between all the tail portions 63*b*. Whenever the lever 67 is depressed in the direction of Arrow B', the tension on the cable 66 increases effecting pivoting of the catches 63*a* & *b* and compression of the spring 63*c* such that the spring biased is overridden and the catches are all retained in the retracted position. The spring bias can be re-engaged upon release of the lever 67 as illustrated. It will be appreciated that a rotatable ring provided with a series of equidistantly spaced peripheral projections aligned to abut and effect pivoting of the catches 63*a* & *b* when the lever 67 is depressed may be substituted for the tensioned cable 66.

With reference to FIGS. 5, 8, 9 & 10, the retrieval/hauling member 49 comprises a releasable split collar 50 and a set of suspension lugs 51, 52. The collar 50 consists of two mirror image substantially crescent shaped sections 53, 54, secured to each other at one end thereof by means of a set of spaced hinges 55. The sections 53, 54 are releasably secured at the opposing ends by a series of external over-centre latch mechanisms 56, 57. Each latch mechanism 56 or 57 comprises a pair of lugs 59, and a releasable latch 58. A lining composed of a low friction material is provided on the internal rim of each section 53*a*, 54*a* and walls defining the throat of the retrieval hauling member 49. The rim lining 53*a*, 54*a* provides a surface area for resting and drapage of the bungy length during hauling and after retrieval, respectively. The throat lining reduces the incidence of abrasive damage to the bungy resulting from repetitive retrieval.

In the open position as depicted in FIG. 5, the latches 58 are disengaged from the lugs 59 and the collar 50 is opened via the articulation of the sections 53, 54 about the hinges 55. To close the collar 50, the free ends of the sections 53, 54 are pulled adjacent whereby the lugs 59 are aligned and the latches 58 are engaged therewith. It will be appreciated that the split collar 50 may be releasably secured by alternate known mechanisms such as bolts, locking pins or similar releasable couplings and/or these mechanisms or over-centre latches may also be used in place of the hinges 55 to split open the collar 50.

In the closed position as depicted in FIGS. 7 and 10, the secured collar 50 is formed with a central throat aperture having rim lining 53*a*, 54*a* adjacent the top opening. The external wall of the nose portion 50*a* is inwardly inclined to function as a contact guide for inter-engagement with the terminal coupling unit 44 to initiate retrieval of the deployed bungy as hereinafter described.

Figure 9:
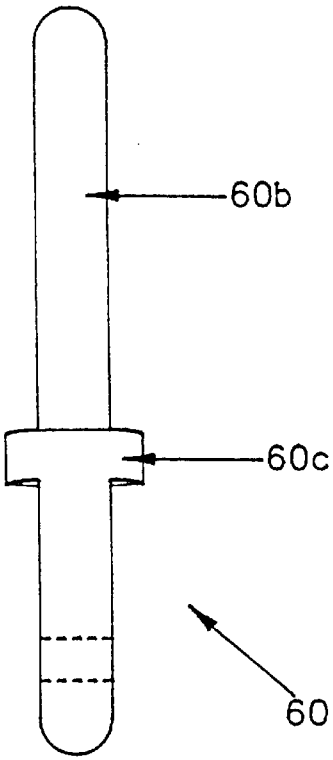
FIG. 9 is a plan view of the retaining mechanism component of FIG. 8.
Figure 8:
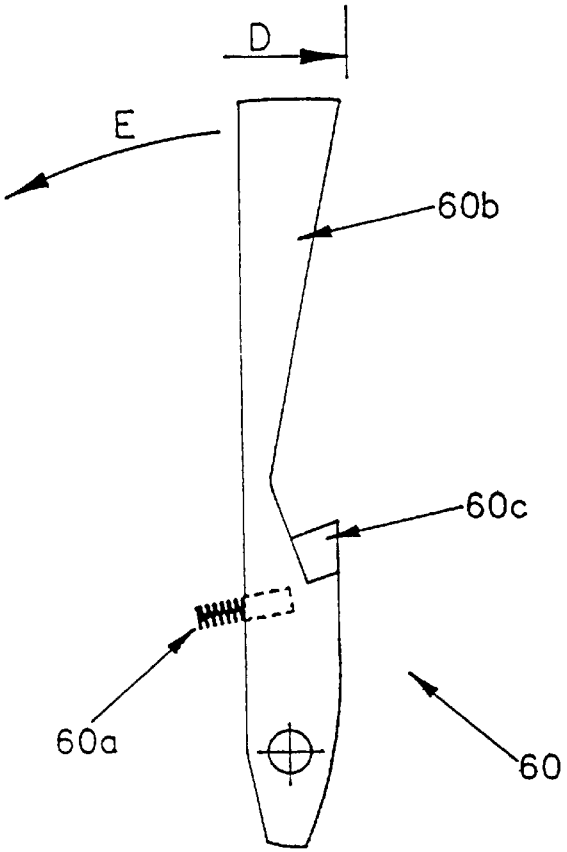
FIG. 8 is a side view of the main component of the retaining mechanism of the retrieval/hauling member of FIGS. 5 & 7.

Referring specifically to FIGS. 5, 7, 8 & 9, each section 53, 54 has a plurality of retractable spring mechanisms 60, 61. With particular reference to FIGS. 7, 8 & 9, each mechanism comprises a catch 60 capable of moving between an extended locking position as shown in FIG. 7 and as indicated by Arrow D, FIG. 8, and a retracted position (indicated by Arrow E, FIG. 8) wherein the catch 60 recedes within a dimensioned slot 61. Each catch 60 is pivotally secured within the base of the slot by bolt 61*a* (FIG. 7 only) and spring biased by a compression spring 60*a* to the extended position wherein the catch arm 60*b* protrudes from the slot 61.

Referring specifically to FIG. 10, each section 53, 54 of the modified retrieval/hauling member 49 includes a nose step 50*b* on the external wall of the nose portion 50*a* in place of the retractable spring mechanisms 60, 61 (FIGS. 5, 7, 8 & 9) as a contact point for inter-engagement with the modified terminal coupling unit 44 to initiate retrieval of the deployed bungy as hereinafter described in detail.

Referring to FIGS. 5–9 & 10, in use, the retrieval/hauling member 49 is attached to the retrieval cable by securing a webbing sling through the apertures of the suspension lugs 51, 52 and using a coupling device to connect the webbing sling to the retrieval cable (not shown). The free end of the bungy is attached to the terminal coupling unit 44 as hereinbefore described and the retrieval cable is connected to a winching system such as a crane operated winch, vehicular winch or windlass (not shown). Alternatively, the retrieval cable is secured for subsequent manual or vehicular tow hauling.

Upon completion of the jump, the jumper may be lowered to a landing site and released from the harness or ankle cuff or remain suspended secured therein for retrieval with the deployed bungy. Jump site crew open the collar 50 and enclose the collar around the bungy by closing the sections 53, 54 around the bungy as hereinbefore described. It will be appreciated that where the retrieval cable is securely tied off or controlled by the winching system, the retrieval/hauling member 49 may be placed on the bungy length adjacent the top at jump set-up and returned to that position after the bungy has been deployed and subsequently retrieved (i.e. between consecutive jumps). The throat lining of the collar 50 prevents abrasive damage and restricts the degree of movement of the bungy length within the throat aperture.

To retrieve the bungy, the retrieval/hauling member 49 is run down the deployed bungy length by gravity feed of the retrieval cable or under winch control until the nose portion 50*a* contacts the ring 47 of the terminal coupling unit 44. The inclined shape of the nose portion 50*a* and lower beveled lip of the ring 47 guides the retrieval/hauling member 49 into the throat aperture of the terminal coupling unit 44.

Referring specifically to FIGS. 5–9, each catch 60 recedes into its respective slot 61 as a portion of the ring 47 contacts the catch arm 60*b* (i.e. said contact overrides the bias of the compression spring 60*a*). When the contact ceases as the retrieval/hauling member 49 continues to fall, the catch 60 returns to the extended position. The inclined sides of the bracket 45 restrict lateral movement of the nose portion 50*a*. The terminal coupling unit 44 contacts and docks with the spring locking mechanisms 60, 61 when the lower lip of the ring 47 becomes seated on and supported by the stop rest of each catch 60*c* (FIGS. 8 & 9). The weight of the bungy and the spring bias of the catches 60 maintain the docked inter-engagement position of the retrieval/hauling member 49 within the throat of the terminal coupling unit 44.

With specific reference to FIG. 10, the nose step 50*b* contacts and docks with the spring mechanisms 63. Docking is achieved by the inter-engagement of each catch head 63*a* with a portion of the peripheral nose step 50*b*; the nose portion 50*a* descends into the throat aperture of the modified terminal coupling unit 44; the nose step 50*b* contacts and pivots the catches 63*a* & *b* in the direction of Arrow B, overriding the bias of the spring 63*c*; the catches 63*a* & *b* spring back into the illustrated extended locking position wherein each catch head 63*a* supports and releasably retains the peripheral nose step 50*b*. The weight of the bungy and spring bias of the catches 63*a* & *b* maintain the docked inter-engagement locking position of the modified retrieval/hauling member 49 within the throat of the modified terminal coupling unit 44.

With reference to FIGS. 5–9 & 10 in general, the winching system is then engaged, or alternatively, the vehicular tow hauling or manual hauling is commenced until the retrieval cable, deployed bungy length, and docked retrieval/hauling member 49 and terminal coupling unit 44 are back above the jump site within the arms reach of the operator. Preferably, said retrieval cable is connected to winching system via a friction-free eddy current coupling member (e.g. a TASC unit) which provides a slipping clutch control such that the operator can brake and/or control the rate of descent and ascent of the retrieval/hauling member 49. To release the terminal coupling unit 44 from the retrieval/hauling member 49, the lever 67, (FIG. 10) is depressed to simultaneously override the spring bias of the catches 63*a* & *b*, or the collar 50, (FIG. 7) is opened and the sections 53, 54 are separated.

Figure 12:
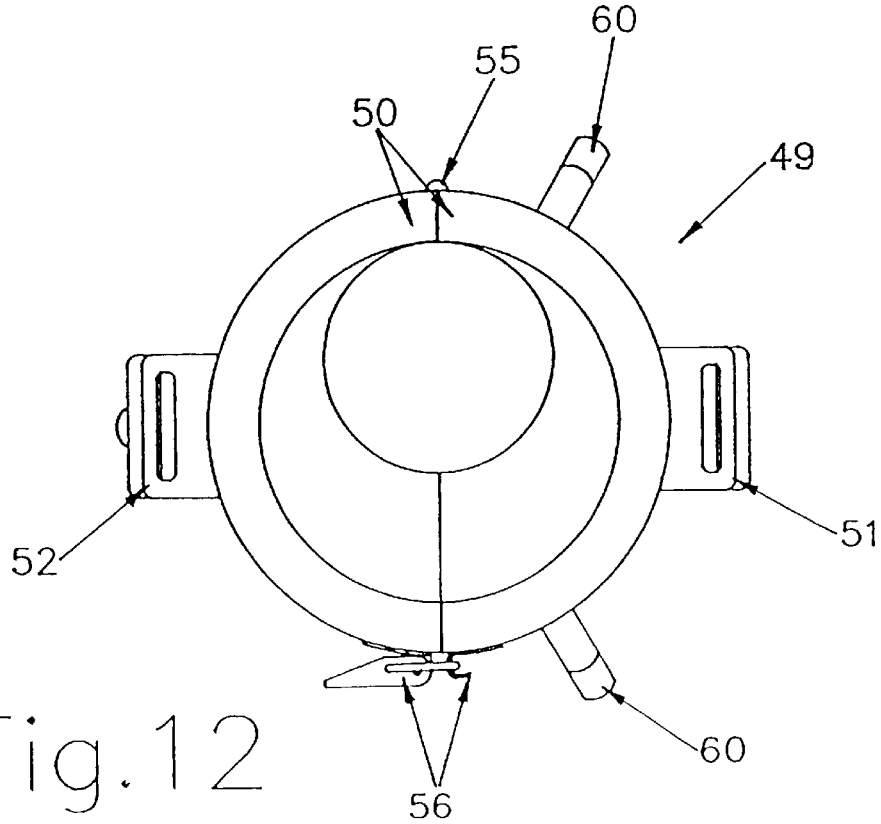
FIG. 12 is a plan view from above showing a modified retrieval/hauling member of FIGS. 5 & 6 wherein the collar aperture is offset.

Whilst the terminal coupling unit 44 (FIGS. 5–9 & 10) has been depicted in described as a substantially open structure, it will be appreciated that the body of the terminal coupling unit may be formed as an open ended substantially cylindrical structure incorporating a means to releasably secure the face end of the bungy and means to connect the harness or ankle cuffs thereto. Similarly, the retrieval/hauling member 49 may be formed in any desired polygonal or substantially cylindrical shape wherein the aperture is concentric or offset as shown in FIG. 12. Further, it will be appreciated that the collar 50 need not be formed in two releasable sections (53, 54), it could be a closed cylinder, so that in use the bungy length would be manually fed through the aperture of the collar 50 (not shown). Similarly, it will be appreciated that the collar 50 need not split completely in half as depicted but may merely include a releasable section having a sufficient opening to allow egress of the bungy length. It will further be appreciated that either the terminal coupling unit or the retrieval/hauling member may be provided with the releasable retaining means biased to a locking position as illustrated in FIG. 10 and FIGS. 5–9 respectively.

What is claimed is:

1. Retrieval equipment for a deployed bungy comprising:

a terminal coupling unit including means to connect the unit with the free end of the bungy, a throat aperture formed in the terminal coupling unit, a retrieval/hauling member adapted to be attached to a retrieval cable and having an aperture through which the bungy may pass, the retrieval/hauling member having an outside dimension to allow the retrieval/hauling member to enter the throat aperture of the terminal coupling unit, a latch mechanism to automatically and releasably secure the retrieval hauling member to the terminal coupling unit when the retrieval/hauling member has entered the throat aperture of the terminal coupling unit, means to release the latch mechanism to separate the retrieval hauling member from the terminal coupling unit; wherein the retrieval/hauling member is substantially cylindrical in shape and is split longitudinally into two sections and wherein the first section is hinged to the second section in a manner that the two sections can be swung to an open position to receive the bungy or swung to a closed position whereby the retrieval hauling member will form a cylinder, means being provided to maintain the two sections in a closed position.

2. The retrieval equipment of claim 1, wherein the means to maintain the two sections in a closed position comprise lugs extending outwardly from each section adjacent the longitudinal split and wherein means are provided which can be engaged with the lugs when the sections are in a closed position to maintain the sections in a closed position.

3. A method of retrieving a deployed bungy using the equipment of claim 1, comprising:

attaching the free end of the bungy to the terminal coupling unit, threading the bungy through the retrieval/hauling member, attaching a retrieval cable to the retrieval/hauling member, deploying the bungy lowering the retrieval/hauling member by means of the retrieval cable down the deployed bungy until the retrieval/hauling member enters the throat aperture of the terminal coupling unit to automatically releasably secure the terminal coupling unit to the retrieval/hauling member, hauling in the retrieval cable to simultaneously lift the terminal coupling unit to which the free end of the bungy is attached and the retrieval/hauling member.

4. The method of claim 3, wherein means are provided to manually release the retrieval/hauling member from the terminal coupling unit.

5. The retrieval equipment of claim 1, wherein the retrieval/hauling member includes a collar having a nose portion and wherein the terminal coupling unit includes a retractable latch member which is spring biased to contact the nose portion of the retrieval/hauling member after the retrieval/hauling member has entered the throat of the terminal coupling unit and to releasable secure the retrieval/hauling member to the terminal coupling unit.

6. The retrieval equipment of claim 5, wherein the retractable latch member is an elongated catch arm having a catch head adjacent one end, the catch arm being pivoted to the terminal coupling unit in a manner that the catch head can move between a retracted position and an extended locking position, the catch arm being spring biased towards the extended locking position, whereby the catch head will contact and releasable lock onto the collar of the retrieval/hauling member when the retrieval hauling member has been engaged in the throat aperture of the terminal coupling unit.

7. The retrieval equipment of claim 6, wherein the catch head is adapted to be unlocked from the collar of the retrieval/hauling member by means of a manual override system connected to the second end of the catch arm and which can be actuated to pivot the catch arm from an extended locking position in which the catch head is locked onto the collar of the retrieval/hauling member to a retracted position whereby the catch head is released from the nose portion of the retrieval/hauling member to enable the retrieval/hauling member to be separated from the terminal coupling unit.

8. The retrieval equipment of claim 7, wherein the manual override system comprises a cable and a lever, said cable having a first end connected to the second end of the catch arm with the second end of the cable being attached to the lever which can be manually moved to pivot the catch arm against the spring biasing in a manner that the catch head will be released from engagement with the collar of the retrieval/hauling member.

* * * * *